United States Patent [19]

Stump

[11] 4,386,506

[45] Jun. 7, 1983

[54] EARRING AND METHOD OF MAKING SAME

[76] Inventor: John L. Stump, E. State St., Delmar, Del. 19940

[21] Appl. No.: 246,852

[22] Filed: Mar. 23, 1981

[51] Int. Cl.[3] ..... A44C 27/00; A44C 7/00

[52] U.S. Cl. ..... 63/13; 29/160.6

[58] Field of Search ..... 63/1, 2, 12, 13; 273/158; 29/160.6

[56] References Cited

U.S. PATENT DOCUMENTS

| | | | |
|---|---|---|---|
| 148,390 | 3/1874 | Tappan | 63/13 |
| 169,940 | 11/1875 | Alden | 63/13 |
| 969,481 | 9/1910 | Jenkins | 273/158 |
| 2,739,596 | 3/1956 | Roberts | 63/13 X |

OTHER PUBLICATIONS

Jones–"Earring Aids", The Sunday Star Magazine, 8/12/56, Washington, D.C.

Geomet–"Hardwear", Esquire Magazine, 6/55, p. 100.

Edmund; p. 84 of Catalog #731, copyright 1972, by Edmund Scientific Co., Barrington, N.J.

*Primary Examiner*—F. Barry Shay

*Attorney, Agent, or Firm*—Harvey B. Jacobson

[57] ABSTRACT

A method of making a jewelry item in the form of an earring having an earlobe hoop which extends through a pierced ear and a dangling portion having a small loop thereon suspended from the earlobe hoop. The dangling portion is an elongated member formed from a handle portion of an acupuncture needle and the hoop is formed by bending the needle shaft portion. The item used is a needle used in clinical acupuncture practice with the material usually being silver, but in some instances being other metals such as gold, platinum, copper or stainless steel with the handle usually being made of finely woven thread silver overlayed on the shaft. The needle shaft portion cut or clipped from the handle shaft portion with a small loop being formed at the distal end of the handle shaft portion. The needle shaft is then bent into a one-piece earlobe hoop which is inserted through a pierced hole in the earlobe and is also inserted through the distal loop formed on the handle portion.

2 Claims, 6 Drawing Figures

EARRING AND METHOD OF MAKING SAME

BACKGROUND OF THE INVENTION

1. Field of the Invention

The present invention generally relates to an earring and more specifically an earring constructed from an acupuncture needle as well as a unique method of using a discarded acupuncture needle to form an earring by following a specific procedural arrangement.

2. Description of the Prior Art

Various types of earrings are known as are acupuncture needles with the following U.S. patents being those known to applicant which relate to this field of invention.

U.S. Pat. No. 262,833—Aug. 15, 1882
U.S. Pat. No. 511,952—Jan. 2, 1894
U.S. Pat. No. 2,642,872—June 23, 1953
U.S. Pat. No. 3,242,540—Mar. 29, 1966
U.S. Pat. No. 3,789,850—Mar. 29, 1966
U.S. Pat. No. 3,993,077—Nov. 23, 1976

SUMMARY OF THE INVENTION

An object of the present invention is to provide an earring including an earlobe hoop having generally inverted U-shaped portion with a fastener assembly securing the free ends thereof together to enable the U-shaped portion to be placed through a pierced earlobe and the fastening arrangement extend under the lower edge of the earlobe to secure the hoop in position together with a dangling elongated rod-like member having a small loop at its upper end received in an offset portion of the hoop adjacent the juncture of one leg of the inverted U-shaped portion and the fastener element which extends transversely under the lower edge of the earlobe.

Another object of the invention is to provide an earring in accordance with the preceding object in which both the earlobe hoop and dangling portion are components of an acupuncture needle with the dangling portion being the handle portion of the conventional needle which includes a woven silver thread or the like wound thereon and secured thereto which produces a unique appearance in the completed earring.

A further object of the invention is to provide a method of making an earring in accordance with the preceding objects in which an acupuncture needle is utilized with the needle shaft portion being removed or clipped off and formed into the earlobe hoop and the handle portion is provided with a small loop at its distal end for positioning on the fastening assembly of the earlobe hoop thereby providing a two-piece earring in which the fastening of the hoop to the earlobe also serves to retain the dangling portion of the earring in position.

Yet another important object of the present invention is to provide an earring and method of making the same in acordance with the preceding objects which is simple in construction, highly unique in appearance, provides effective utility for normally discarded acupuncture needles and enables effective earring structures to be constructed by utilizing acupuncture needles by following a plurality of procedural steps each of which individually can be accomplished by using simple hand tools and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
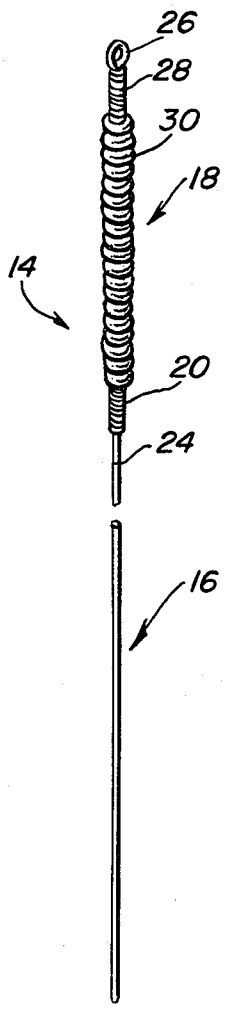
FIG. 1 is a perspective view of an acupuncture needle with the needle shaft thereof being severed.
Figure 5:
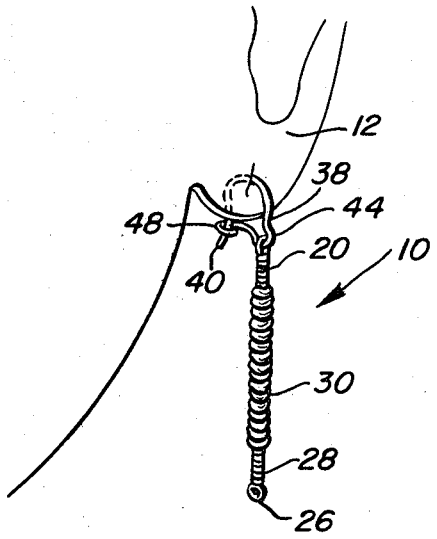
FIG. 5 is a perspective view illustrating the manner in which the earlobe hoop and fastener are associated with the pierced earlobe and the handle portion dangles therefrom with the distal loop being received in the offset portion of the earlobe hoop at the juncture of one leg of the hoop and the fastener member.

Referring now specifically to the drawings, the earring of the present invention is generally designated by the numeral 10 and is illustrated in completed and assembled form and supported from a pierced earlobe 12 in FIG. 5 with the earring being formed by using an acupuncture needle 14 illustrated in its entirety in FIG. 1 and including a needle shaft generally designated by numeral 16 and a handle portion generally designated by the numeral 18, the needle shaft 16 being shown cut or severed from the handle portion. Any suitable implement (not shown) may be used to clip the needle shaft 16 from the handle portion 18 at a position spaced slightly from a woven thread 20 at the distal end of the handle portion so that a small distal loop 22 may be formed by or on the distal end of the continuation of the rod-like shaft 24 which extends all the way through the handle portion 18 and terminates in a proximal loop 26. The wound thread 20, 28 and the plurality of annular members 30 form a decorative and functional handle for the acupuncture needle and represents conventional acupuncture needle structure with the entire needle being constructed of silver, other precious metals, stainless steel, and the like.

Figure 3:
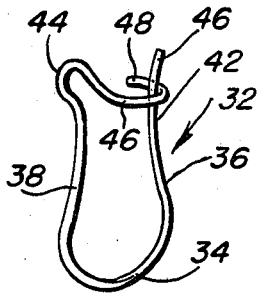
FIG. 3 is a perspective view of the needle shaft portion of the acupuncture needle of FIG. 1 illustrating the manner in which it is bent and formed to provide an earlobe hoop with a hook-like fastener arrangement extending from one leg of the hoop to the other to form a detachable fastener across the open end of the hoop.
Figure 4:
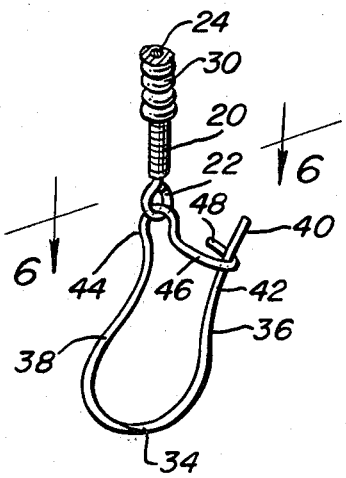
FIG. 4 is a perspective view illustrating the assembly of the earlobe hoop and the handle portion of the acupuncture needle with the fastener portion of the hoop extended through the distal loop on the handle portion.
Figure 6:
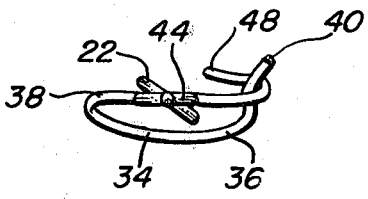
FIG. 6 is a plan sectional view taken substantially upon a plane passing along section line 6—6 of FIG. 4 illustrating further structural details of the earlobe hoop and the association of the handle portion therewith.
Figure 2:
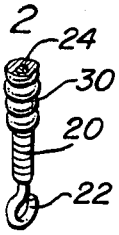
FIG. 2 is a fragmental perspective view of the distal end of the handle portion of the acupuncture needle illustrating the small loop formed thereon.

The needle shaft 16 is formed into an earlobe hoop generally designated by numeral 32 and which is generally U-shaped in construction with a generally semi-circular bight portion 34 and a pair of generally parallel legs 36 and 38 with the legs being slightly more closely spaced than and extending at a slight angle to the tangents of the semi-circular bight portion 34 as illustrated in FIG. 3 with the leg 36 terminating in a curved free end portion 40 which includes an outwardly facing concave surface 42. The other leg 38 includes an offset inwardly facing U-shaped loop or recess 44 formed therein with a transversely extending closure member 46 for the U-shaped earlobe hoop 32 with the closure member 46 terminating in a laterally opening hook 48 which opens toward the offset portion or recess 44 and hooks around the free end portion 40 of the leg 36 which extends beyond the hook 48 with the bight portion of the hook 48 being received in and on the concave surface 42. This enables the free end portion 40 of the leg 36 to be passed through the pierced earlobe 12 when the hook 48 is, of course, disengaged and the hook may then be engaged with the free end portion 40 to secure the earlobe hoop 32 in position. Also, the handle portion 18 or dangling portion of the earring may be attached to the loop 22 in the same manner, that is, by disconnecting the leg 36 from the hook 48 and then inserting the free end portion 40 of the leg 36 through the loop 22 and turning the hoop 32 until the offset loop 44 is received in the loop 22 as illustrated in FIG. 4. With this arrangement, the assembly of the two components of the earring is complete and the assembled earring may then be placed on the earlobe 12 by inserting the free end portion 40 of the inverted U-shaped earlobe hoop 32 through the hole in the pierced earlobe 12 and the rounded bight portion 34 engaged with the hole and the free end portion 40 then depending below the bottom of the earlobe 12 after which the hook 48 may be engaged with the free end portion 40 of the leg 36 thereby forming a fastener for detachably retaining the earlobe hoop 32 and thus the earring to the earlobe 12 and preventing dislodgement of the dangling portion of the earring 10 from the earlobe hoop 32.

This type of jewelry enables an acupuncturist to make effective use of discarded or new acupuncture needles with these needles normally constructed of silver or other precious metals although in some instances they are constructed of stainless steel. In any event, the thread-fine silver which is overlayed on the shaft of the handle portion of the acupuncture needle provides a highly unique appearance to the dangling portion of the earring and produces an earring which is highly intriguing to others since they provide a unique appearance and, in some cases, may have therapeutic value when inserted into particular acupuncture auricular points in the earlobe.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. The method of making earrings and jewelry from discarded acupuncture needles wherein a major portion thereof constitutes a needle shaft and the other portion is the handle portion of the needle, the method consisting of the steps of clipping the major portion of the needle shaft of the acupuncture needle from the handle portion of the acupuncture needle to form two separate components thereof, forming a small loop in the distal end portion of the handle portion which has been clipped from the needle shaft, and forming the needle shaft into a substantially U-shaped earlobe hoop including forming a fastener means for extending across the open end of the U-shaped hoop, forming an offset loop in the juncture between one leg of the U-shaped hoop and the fastener means, inserting the free end of the other leg of the hoop through the distal loop on the handle portion so that it is received in the offset loop in the U-shaped hoop, inserting the free end of the other leg of the hoop through a pierced earlobe and securing the fastener means across the space between the legs of the hoop to secure the hoop to the earlobe and retain the handle portion of the acupuncture needle in dangling position with respect to the earlobe, said step of forming the fastening means includes forming the free end of one leg of the U-shaped hoop as a fastener member with a hook-shaped free end for detachable engagement with the free end of the other leg of the U-shaped hoop with the fastener member extending under the earlobe from front to rear with the hook-shaped end thereof disposed rearwardly of the earlobe and the offset loop in the hoop being disposed forwardly of the earlobe thereby disposing the dangling portion of the earring forwardly of the earlobe.

2. The method as defined in claim 1 together with the step of extending said other leg of the hoop beyond the hook-shaped end of the fastener member and forming a concave surface on the surface of said other leg that is engaged by said hook-shaped end on the fastener member.

* * * * *